US008695648B2

(12) United States Patent
Meyer

(10) Patent No.: US 8,695,648 B2
(45) Date of Patent: Apr. 15, 2014

(54) FUEL PUMP NOZZLE

(75) Inventor: Heinz-Ulrich Meyer, Hamburg (DE)

(73) Assignee: Elaflex Hiby Tanktechnik GmbH & Co., Hamburg (DE)

( * ) Notice: Subject to any disclaimer, the term of this patent is extended or adjusted under 35 U.S.C. 154(b) by 349 days.

(21) Appl. No.: 13/105,627

(22) Filed: May 11, 2011

(65) Prior Publication Data

US 2011/0277880 A1 Nov. 17, 2011

(30) Foreign Application Priority Data

May 14, 2010 (EP) ..... 10005085

(51) Int. Cl.
*B67C 3/00* (2006.01)
*B67D 7/48* (2010.01)

(52) U.S. Cl.
CPC ..... *B67D 7/48* (2013.01)
USPC ..... 141/208; 141/206

(58) Field of Classification Search
CPC ..... B67D 7/48
USPC ..... 141/59, 206–210
See application file for complete search history.

(56) References Cited

U.S. PATENT DOCUMENTS

| | | | | |
|---|---|---|---|---|
| 4,331,187 A | | 5/1982 | Trygg | |
| 4,913,200 A | * | 4/1990 | Carow | 141/217 |
| 5,386,859 A | * | 2/1995 | Healy | 141/59 |
| 5,832,970 A | * | 11/1998 | Carow | 141/206 |
| 6,095,204 A | * | 8/2000 | Healy | 141/59 |
| 6,953,026 B2 | | 10/2005 | Yu et al. | |
| 2005/0166971 A1 | | 8/2005 | Arov et al. | |

FOREIGN PATENT DOCUMENTS

| | | |
|---|---|---|
| DE | 7016168 U | 9/1970 |
| DE | 4431547 C1 | 10/1995 |
| DE | 10 2008010 988 B3 | 7/2009 |
| WO | 2010/033115 | 3/2010 |

OTHER PUBLICATIONS

English Abstract of DE 10 2008010 988 B3, Published Jul. 16, 2009.
English Abstract of DE 4431547, Published Oct. 12, 1995.
EPO Machine English Translation of DE7016168 U Description, Published Sep. 17, 1970.

* cited by examiner

*Primary Examiner* — Timothy L Maust
(74) *Attorney, Agent, or Firm* — Casmir Jones, S.C.

(57) ABSTRACT

The subject matter of the invention is a fuel pump nozzle, with an inlet (2), a discharge pipe (3), a main valve for controlling the stream of liquid between the inlet (2) and discharge pipe (3), a switching lever (4) for actuating the main valve, a first automatic safety shut-off which moves the main valve into the closed position if the liquid level in a tank to be filled reaches a filling level sensor arranged in the region of the discharge pipe (3), a second automatic safety shut-off which moves the main valve into the closed position if the liquid pressure at the inlet (2) drops below a minimum value, and a mechanism (13) for prestressing the main valve into the closed position, said mechanism bringing about a variable opening cross section of the main valve depending on the liquid pressure at the inlet (2). According to the invention, the main valve is pressed into the closed position in a tilted manner under the action of the mechanism for prestressing the main valve into the closed position in the full hose mode such that the tightness of said main valve is reduced.

12 Claims, 6 Drawing Sheets

FUEL PUMP NOZZLE

This application claims the benefit of European Application No. 10005085.5, filed May 14, 2010.

The invention relates to a fuel pump nozzle, with an inlet, a discharge pipe, a main valve for controlling the stream of liquid between the inlet and discharge pipe, a switching lever for actuating the main valve, a first automatic safety shut-off which moves the main valve into the closed position if the liquid level in a tank to be filled reaches a filling level sensor arranged in the region of the discharge pipe, a second automatic safety shut-off which moves the main valve into the closed position if the liquid pressure at the inlet drops below a minimum value, and a mechanism for prestressing the main valve into the closed position, said mechanism bringing about a variable opening cross section of the main valve depending on the liquid pressure at the inlet.

A fuel pump nozzle of this type is known, for example, from U.S. Pat. No. 4,331,187.

Fuel pump nozzles, also called fuel nozzles, at gasoline filling stations are generally designed in the form of "automatic fuel pump nozzles". They have an automatic shut-off which prevents the fuel tank from overflowing. Said automatic safety shut-off generally acts on the main valve of the fuel pump nozzle.

Many filling pumps enable the user to preselect the quantity of fuel to be replenished. If, for example, payment takes place in the form of an advance payment directly at the filling pump by means of coins, bank notes or credit cards, the advance payment made can determine the quantity of fuel to be dispensed. Other filling pumps permit the preselection of a certain quantity of fuel independently of the type of payment or an amount to be paid per depression of a key.

When a certain filling quantity is preselected, the end of the fuelling operation is generally not triggered by the triggering of the safety shut-off described when the tank is full but rather by the preselected quantity of fuel being reached. Said quantity of fuel is generally controlled by appropriate activation of the fuel pump in the filling pump. Shortly before the desired filling quantity is reached, the feed power of the pump is reduced, and then the pump is completely shut off when the preselected filling quantity is reached.

Since, in this case, the automatic safety shut-off of the fuel pump nozzle is not triggered, the fuel pump nozzle in the position in which it is still open may in principle be hung back into the filling pump, which may result in an uncontrolled outflow of fuel during subsequent fuelling operations.

It has therefore already been proposed (U.S. Pat. No. 4,331,187) to provide a second automatic safety shut-off which completely closes the main valve of the fuel pump nozzle again even if the pressure at the inlet of the fuel pump nozzle drops below a certain threshold value. This is supposed to ensure that, after shutting off the fuel feed pump in the filling pump and after a resultant drop in the pressure at the inlet of the fuel pump nozzle, automatic closing takes place.

A problem in this connection is that, in the described minimum feed mode shortly before a preselected quantity of fuel is reached, there is likewise only a low pressure at the inlet of the fuel pump nozzle. On the other hand, even after completely shutting off the fuel feed pump, the drop in pressure at the inlet of the fuel pump nozzle may be delayed or the pressure may even increase again if, for example, fuel fed out of a cold buried tank is heated in a black fuel hose, on which the sun has shone, between the filling pump and fuel pump nozzle.

The present invention is based on the object of providing a fuel pump nozzle of the type mentioned at the beginning which, in a structurally simple and favorable manner, firstly permits reliable operation even at a low feed power and secondly reliably closes the main valve after the fuel feed pump has been completely shut off.

The invention achieves this object in a fuel pump nozzle mentioned at the beginning in that the main valve is pressed into the closed position in a tilted manner under the action of the mechanism for prestressing the main valve into the closed position in the full hose mode such that the tightness of said main valve is reduced.

Some of the terms used in the context of the invention should be explained first.

The requirements for the construction and operation of automatic fuel pump nozzles for use on filling pumps are regulated in DIN EN13012:2001. Terms defined there are also used in the present application.

A fuel pump nozzle is a device for the manual control of the flow of fuel during a refueling operation. The inlet is that region of the fuel pump nozzle through which fuel is supplied by the filling pump. The main valve is the device which controls the flow of fuel. The term main valve does not imply that there has to be a second valve, secondary valve or the like. The switching lever is the device by means of which the user controls the main valve. This charge pipe is the device through which the flow of fuel is conducted into the tank to be filled.

The first automatic safety shut-off moves the main valve into the closed position when a filling level sensor arranged in the region of the discharge pipe is activated. This may in particular involve a flow and/or pressure sensor, as known from the prior art and which is described in more detail below.

The second automatic safety shut-off likewise moves the main valve into the closed position if the liquid pressure at the inlet of the fuel pump nozzle drops below a minimum or threshold value.

The mechanism for prestressing the main valve into the closed position acts upon the main valve permanently with a force or prestress acting into the closed position. The purpose of said mechanism is in particular, in the "full hose mode" in which the fuel pump of the filling pump is no longer feeding fuel and the connecting hose between the filling pump and fuel pump nozzle is full of liquid, to prevent the hose running dry through the fuel pump nozzle. The requirements of a mechanism of this type are defined in DIN EN13012:2001, number 6.B.6 (discharge test). Said mechanism may in particular be a "full hose spring" which permanently exerts a force in the direction of the closed position. The force has to be dimensioned such that, firstly, the abovementioned discharge test is covered and, secondly, said force may only be of a size such that even the extremely small pressure provided during minimum feeding suffices to partially open the main valve counter to the force of said full hose spring. A further purpose of the abovementioned mechanism is to variably configure the opening cross section of the main valve depending on the feed pressure and flow rate such that a drop in pressure takes place via the main valve permitting pressure control of the above-mentioned second automatic safety shut-off.

According to the invention, the main valve is pressed into the closed position in a tilted manner under the action of the mechanism for prestressing the main valve into the closed position in the full hose mode such that the tightness of said main valve is reduced.

To press into the closed position in a tilted manner means that the axial guide of the valve encloses an angle with the axial direction of the valve seat such that the valve seals in a manner differing in tightness over the circumference of the valve seat. Instead or in addition, the tilting may also take place by the force acting in the closing direction not acting symmetrically in the axial direction on the valve in the full hose mode and therefore pressing the valve into the closed position in a tilted manner. According to the invention, said tilting takes place only under the action of the mechanism for prestressing the main valve into the closed position in the full hose mode. Full hose mode means that there is no feeding of liquid but that the main valve has not been closed again either by one of the above-described first or second automatic safety shut-offs or manually by the user. The above-mentioned mechanism which generally comprises a full hose spring then prevents the hose connecting the filling pump and the fuel pump nozzle from being discharged through the fuel pump nozzle.

The tightness of the main valve is reduced in the full hose mode. Reduced means that said tightness is less than in the case of a symmetrical, non-tilted prestressing into the closed position by a mechanism (full hose spring) acting with equivalent force. The tightness is preferably reduced to a level providing an action which is still sufficient as discharge protection in the full hose mode.

The core of the invention is to reduce the tightness of the main valve in the full hose mode in a specific manner by means of the structural measure described such that, firstly, the required discharge protection is still ensured and, secondly, the pressure at the outlet drops due to said lack of tightness in the full hose mode so as to reliably drop below the switching threshold of the second automatic safety shut-off, i.e. the minimum pressure at the outlet, at which, when the pressure drops therebelow, said second automatic safety shut-off moves the main valve into the closed position. The reduced tightness therefore ensures that an excess of pressure possibly still present after the fuel feed pump has been shut off, or a pressure building up in a warm hose, for example due to thermal expansion of cold fuel, is dissipated in order to ensure that the pressure drops below the minimum pressure of the second automatic safety shut-off.

If the main valve is moved into the closed position by triggering of the first or second automatic safety shut-off or manually by actuation of the switching lever, a suitable mechanism, for example a closing spring, generally exerts a considerably higher force on the main valve in the direction of the closed position than the full hose spring described. Furthermore, greater closing force acts in such a manner that the described tilting, as present in the full hose mode, is present at most, if at all, in an extent such that the complete tightness of the main valve is ensured under the required operating conditions, i.e. even after the feed pump has started up again and a corresponding pressure is building up at the inlet of the fuel pump nozzle. For example, within the context of the invention, the full hose spring can act on the main valve from the inlet side, and the separate closing spring can act from a direction downstream of the main valve, as described in more detail in the exemplary embodiment.

The main valve is preferably designed according to the invention as a conical valve. The valve cone can have a guide which is designed such that the main valve is pressed against the valve seat with an asymmetrical distribution of force under the action of the mechanism for prestressing the main valve into the closed position in the full hose mode. For example, the valve cone guide can enclose an angle with the axial axis of symmetry of the valve seat such that the valve cone is pressed asymmetrically, i.e. obliquely, into the valve seat under the action of the mechanism which is designed in particular as a full hose spring. The sealing pressures of the valve then differ over the circumference of the valve seat.

According to the invention, it is preferred for the sealing pressure of the main valve in the full hose mode to be between 0.1 and 0.15 bar. Within the scope of DIN EN13012:2001, the sealing pressure has to be at least 0.1 bar since, in the discharge test according to number 6.B.6 of said standard, the tightness is tested under a liquid column from a meter. However, on the other hand, the sealing pressure is supposed to be low enough to maintain an operationally reliable distance from the switching threshold of the second automatic safety shut-off. The term sealing pressure refers to the liquid pressure at the inlet of the fuel pump nozzle at which the main valve allows at most small quantities of liquid through, if any at all, in the full hose mode; small quantities of liquid in this context are defined in DIN EN13012:2001, number 6.B.6.

When, if a certain quantity of fuel has been preselected in the course of a refueling operation, said preselected quantity of fuel has virtually been reached, the feeding power of the fuel pump of the filling pump is reduced, as described above, so that the preselected refueling quantity can be activated with total precision and the fuel pump can then be shut off.

The minimum feeding power of the pump and therefore the flow rate through the fuel pump nozzle during said minimum feeding operation can be, for example, 2 l/min. At said minimum feeding power, there can be, for example, a pressure of 0.27 bar at the inlet. At said pressure, the second automatic safety shut-off should not yet be triggered. If the fuel pump stops completely after the preselected feeding quantity is reached, the main valve closes under the action of the full hose spring. By means of the design according to the invention, the tightness of the main valve is now reduced to such an extent that an excess of pressure which may still be present (or which arises, for example, due to solar insolation on the hose) at the inlet escapes by means of leakage at the main valve until the sealing pressure is reached in the full hose mode (for example 0.1 bar). The switching threshold of the second automatic safety shut-off is preferably set approximately in the middle between the operating pressure at minimum feeding power and the sealing pressure of the main valve in the full hose mode. In the example mentioned (pressure at the inlet at minimum feeding pressure 0.27 bar, sealing pressure in the full hose mode 0.1 bar), the switching threshold can be set, for example, to 0.17 bar. Said switching threshold then has a significant distance from the operating pressure at minimum feeding power, on the one hand, and from the sealing pressure, on the other hand. This prevents the second automatic safety shut-off from inadvertently being triggered in the event of small fluctuations in the operating pressure in the minimum feeding mode or prevents said triggering from not happening after stopping of the fuel feed pump in the filling pump. According to the invention, the switching threshold of the second automatic safety shut-off can therefore be, for example, at least 0.05 bar, preferably at least 0.1 bar above the sealing pressure of the main valve in the full hose mode.

The main valve preferably has a valve stem guide which tilts under the action of the mechanism for prestressing the main valve into the closed position in the full hose mode and guides the valve stem of the main valve at an angle to the axis of symmetry of the main valve seat. The valve stem is thereby guided obliquely in a specific manner. The valve stem guide can be a component which is secured in the flow duct of the inlet, guides the valve stem by means of a preferably cylindrical sleeve and has holding regions, in particular holding arms, which extend radially outward and secure the valve stem guide in the radially outer region of the inlet. Said radially outwardly extending holding regions are preferably designed for axial supporting or bearing against an abutment. If the full hose spring exerts a force acting in the closing direction on the main valve, said full hose spring is generally supported on an upstream end piece of the valve stem, on the one hand, and on an axial end surface of the valve stem guide, on the other hand. It thereby presses the valve stem guide downstream in the axial direction against the abutment in the inlet. According to the invention, it can be provided that, by means of said pressing against the abutment, tilting of the valve stem guide takes place. This means that the valve stem guiding sleeve encloses an angle with the axis of symmetry of the main valve or valve seat. According to the invention, the tilting can be brought about, for example, by, in the region of the contact surfaces with the abutment, the holding regions of the valve stem guide having spacers facing in the axial direction in subregions of the circumference. Said spacers, merely over part of the circumference of the valve stem guide, tip the valve stem guide and therefore also the stem guiding sleeve guiding the valve stem toward the axis of symmetry and therefore cause the full hose spring to press the main valve into the valve seat in a tilted manner and therefore to reduce the sealing pressure.

Furthermore, the subject matter of the invention is a valve stem guide for a fuel pump nozzle according to the invention. Said valve stem guide has a stem guiding sleeve for guiding a valve stem and holding regions, preferably holding arms, extending radially outward from the stem guiding sleeve. Said holding regions are designed to bear axially against an abutment in the inlet of a fuel pump nozzle. According to the invention, when the holding regions are pressed against an abutment of rotationally symmetrical design, the stem guiding sleeve takes up an angular position at which the axis of symmetry thereof differs from the axis of symmetry of the abutment of rotationally symmetrical design. This can take place, for example, by the spacers which have already been described and face in the axial direction only in subregions of the circumference.

An exemplary embodiment of the invention is described below with reference to the drawings, in which.

Figure 1:
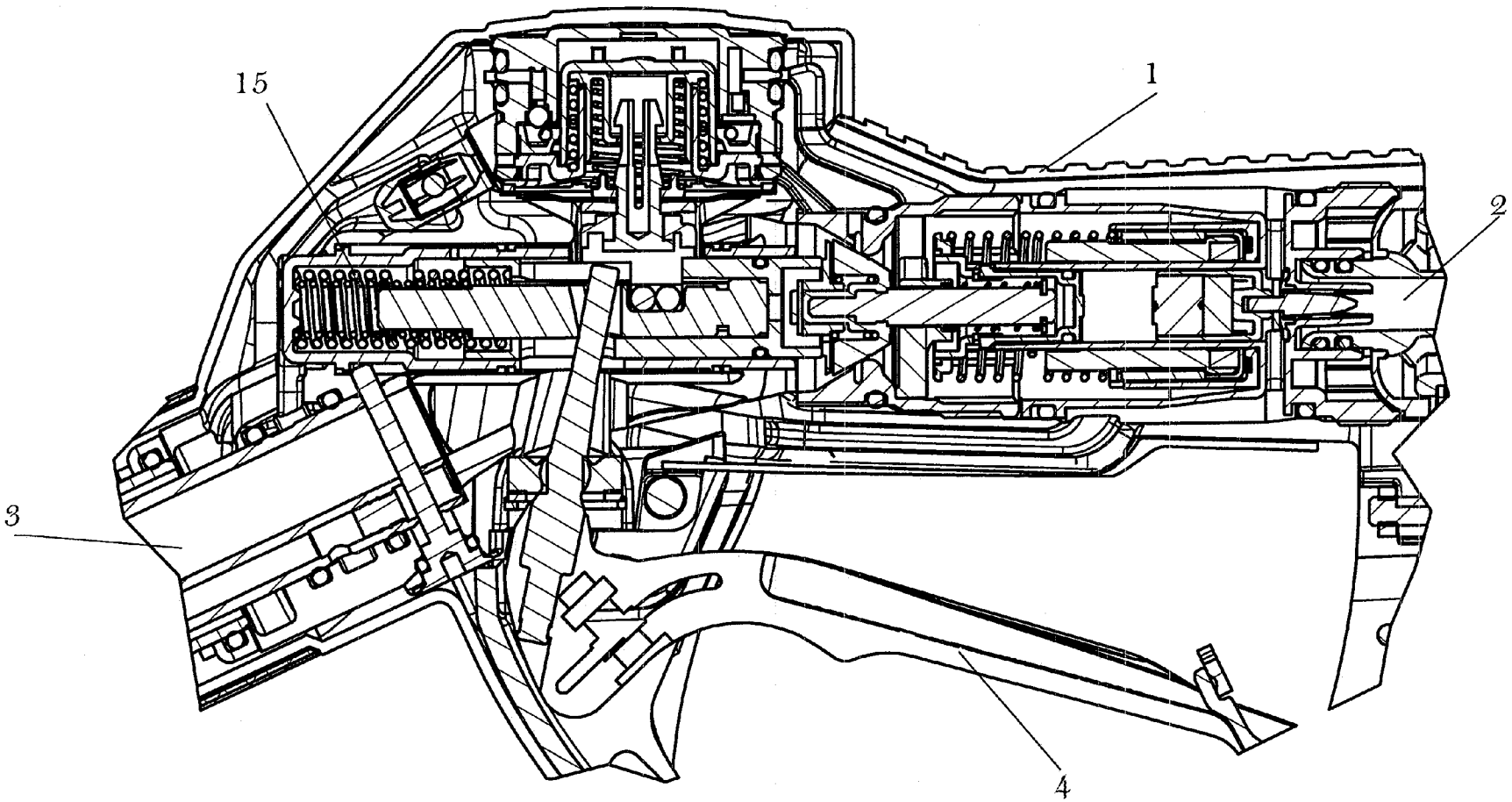
FIG. 1 shows a section through part of a fuel pump nozzle according to the invention.

A fuel pump nozzle according to the invention (also called fuel nozzle colloquially) has a valve housing 1, an inlet 2 which is connected to a hose (not illustrated) for liquid, a discharge pipe 3 and a switching lever 4. The main valve is arranged in the interior of the valve housing 1. Said main valve has a conical valve seat 5 and a valve cone 6. The valve cone 6 is divided into two partial bodies 6*a* and 6*b*. The larger partial body 6*a*, which is arranged upstream in the direction of flow of the main valve, is connected fixedly to the valve stem 7. The second partial body 6*b* is arranged in an axially displaceable manner on the valve stem 7, and the two partial bodies 6*a* and 6*b* are pressed apart by a spring 8 such that an axial gap, indicated at 9, can form therebetween.

The valve stem 7 is guided by a valve stem guide which has a stem guiding sleeve 10 and holding regions 11 running radially outward from said stem guiding sleeve 10. Said holding regions 11, indicated at 12, bear axially against an abutment formed in the valve housing 1.

A full hose spring 13 is designed as a compression spring and bears against the upstream axial end of the valve stem guiding sleeve 10, on the one hand, and against a head piece or end piece 14 of the valve stem 7, on the other hand. Said full hose spring endeavors to draw the main valve into the closed position in which the partial body 6*a* comes to bear in a sealing manner against the valve cone seat 5.

In the closed position illustrated in FIGS. 1 and 2, the main valve is additionally pressed into the closed position by a downstream closing spring 15, as described below.

Figure 2:
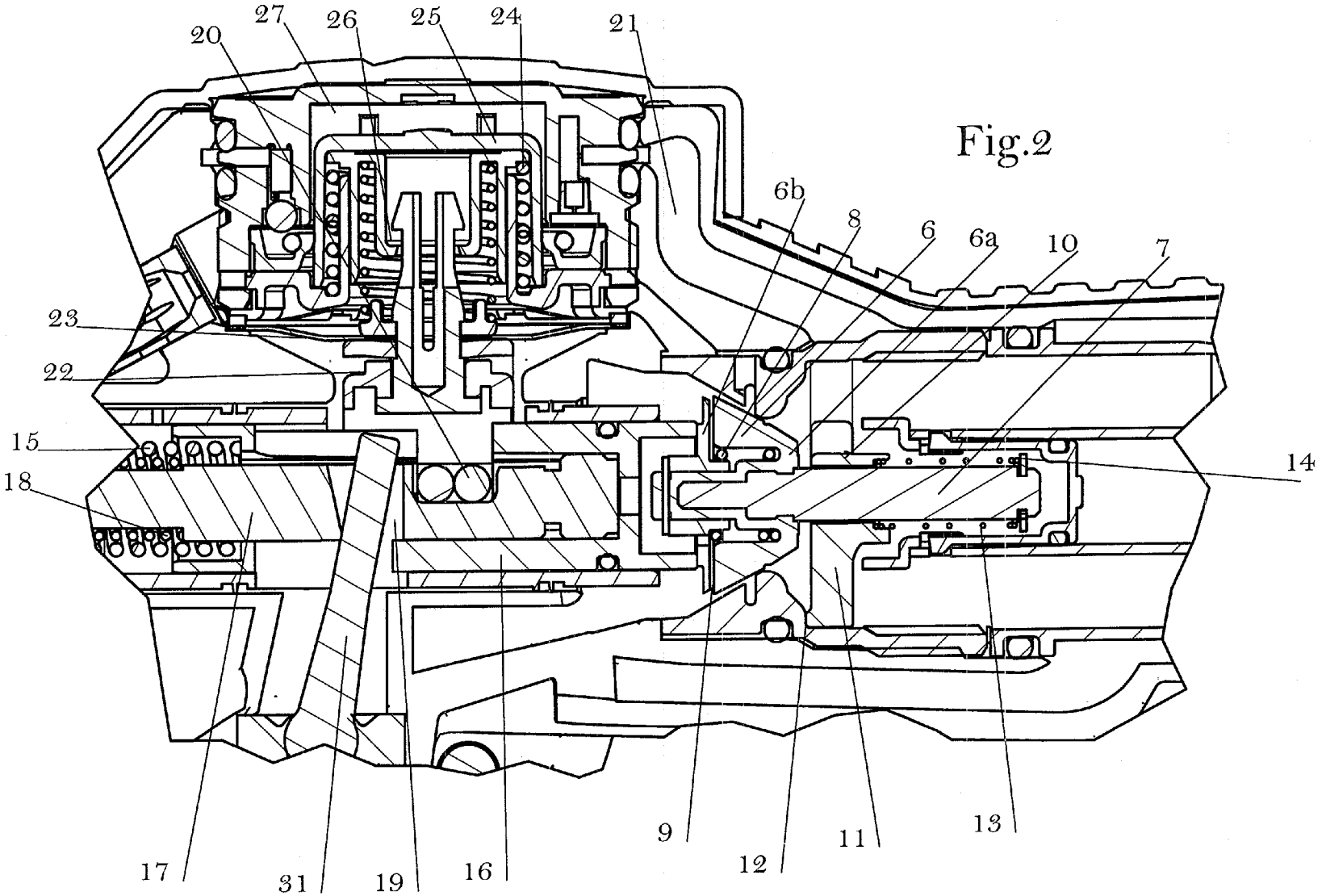
FIG. 2 shows an enlarged partial view from FIG. 1.

As can be seen in FIGS. 1 and 2, the closing spring 15 presses an outer piston 16 of hollow design against that end side of the main valve which faces downstream, i.e. of the second partial body 6*b*. The closing force of the closing spring 15 is therefore brought via the outer piston 16 to act on the second partial body 6*b*. Said closing force is of a magnitude such that the two partial bodies 6*a* and 6*b* of the valve cone are compressed counter to the action of the spring 8, and the main valve seals completely tightly upon any operating pressure present on the inlet side. The closing force of said closing spring 15 is therefore significantly larger than the force exerted in the closing direction on the main valve by the full hose spring 13. The closing spring 15 and the outer piston 16 used to pass on the force press the main valve from the downstream side fully symmetrically (therefore not obliquely or tilted) into the associated valve seat 5.

An inner piston 17 is arranged in an axially displaceable manner in the outer piston 16. The inner piston 17 is prestressed in the direction of the closed position by a restoring spring 18. The inner piston 17 can be moved downstream in the axial direction by actuation of the switching lever 4. When the switching lever 4 is pulled by the user, the switching lever bolt 31, which is connected to the switching lever 4 and engages in a bore or groove 19, which runs in the radial direction, of the inner piston 17, presses said inner piston 17 downstream in the axial direction counter to the prestressing of the restoring spring 18.

As already mentioned, the inner piston 17 is arranged in an axially displaceable manner in the outer piston 16, but the inner piston 17 and outer piston 16 can be kinematically connected to each other by means of a locking device to be described, and therefore the downstream movement of the inner piston 17 likewise moves the outer piston 16, which is coupled thereto, downstream and therefore takes the closing force of the closing spring 15 from the partial body 6*b* of the main valve. Said connection or locking of the outer piston 16 and inner piston 17 by locking members referred to as membrane rollers 20 is basically known in the prior art and described, for example, in U.S. Pat. No. 4,331,187 or DE 10 2008 010 998 B3. In the position illustrated in FIGS. 1 and 2, the membrane rollers 20 are arranged in aligned recesses of the outer piston 16 and inner piston 17 in such a manner that the outer piston 16 and inner piston 17 are locked to each other and, by actuation of the switching lever 4, the inner piston 17 and outer piston 16 are displaced together downstream axially counter to the force of the closing spring 15 and restoring spring 18. If the switching lever 4 is actuated only slightly and accordingly there is only a small axial displacement of the two pistons, first of all the second partial body 6*b* of the main valve is relieved of load and the spring 8 can drive the first partial body 6*a* and the second partial body 6*b* apart in the axial direction, thus forming the gap 9. The tightness of the main valve is now reduced and, when pumping pressure is present at the inlet 2, the flow of small quantities of fuel to the discharge pipe 3 is possible.

If the switching lever 4 is pulled further, the outer piston 16 moves further away from the main valve, and therefore the latter is now pulled into the closed position only by the full hose spring 13. The pumping pressure present at the inlet 2 during a regular refueling operation is significantly greater than the sealing pressure under the action of the full hose spring 13, and therefore liquid or fuel can now flow through the main valve at a high flow rate. Since the full hose spring 13 draws the main valve in the direction of the closed position at all times even during the refueling operation, a certain drop in pressure takes place via the main valve, and the pressure present at the inlet upstream of the main valve is also imparted to a pressure port duct 21.

The refueling operation can be ended by the switching lever 4 being let go of by the user or a possible latching of the switching lever 4 being released. The closing spring 15 and restoring spring 18 then press the inner piston 17 and outer piston 16 back into the closed position and close the main valve.

However, a refueling operation is frequently not ended manually in this manner but rather by the triggering of automatic safety shut-offs either when the tank is full or upon reaching a preselected quantity of fuel after the pump is shut off.

Both the first and the second automatic safety shut-off are based on the principle of drawing the membrane rollers 20 out of the grooves or recesses of the inner piston 17 and outer piston 16 and of thereby releasing the locking of said pistons to each other. The outer piston 16 can then snap back into the closed position under the action of the closing spring 15 and the main valve can be acted upon again from downstream by the large closing force described. After such a triggering of the safety shut-off, the inner piston 17 is initially still in the position displaced axially downstream because of the switching lever 4 being pulled as before. The recesses for the membrane rollers 20 in the inner piston 17, on the one hand, and outer piston 16, on the other hand, are no longer aligned with one another. Only when the switching lever 4 is released and the restoring spring 18 can move the inner piston 17 back into the starting position thereof are the recesses aligned again with one another and the membrane rollers 20 can optionally again lock the inner and outer pistons to each other. It is thereby ensured that, after triggering of the automatic safety shut-off, a new refueling operation can begin only when the switching lever 4 has first of all been released and moved back into the inoperative position thereof.

The membrane rollers 20 can be drawn upwards (with reference to the illustration in FIG. 2) out of the recesses in the inner piston 17 by means of a holder 22 and can thereby cancel the lock between the inner piston 17 and outer piston 16. Said drawing out of the holder 22 and therefore of the membrane rollers 20 can take place, firstly, under the action of changes in pressure on both sides of a membrane 23 (first automatic safety shut-off) and, secondly, by the piston 25 being moved upward out of the position illustrated in FIG. 2 under the action of the spring 24 and, in the process, also drawing the holding device 22 upward under the action of the telescopic coupling 26 and, by drawing out the membrane rollers 20, releasing the lock between the inner piston 17 and outer piston 16. So that the piston 25 moves into the lower position shown in FIG. 2, a pressure has to prevail in the space 27 above the piston 25, the pressure being greater than the upwardly acting force of the spring 24. Said space 27 communicates with the pressure port duct 21 such that the same pressure which is also present at the inlet of the fuel pump nozzle prevails therein. The piston 25 is therefore moved into the lower position, which is illustrated in FIG. 2, and therefore permits locking of the inner piston 17 and outer piston 16 and hence the refueling operation, only if a certain minimum pressure, which is 0.17 bar in the exemplary embodiment, is present at the inlet 2 of the fuel pump nozzle. If the pressure drops below said switching threshold, the piston 25 moves upward, draws the membrane rollers 20 out of the locking position thereof and therefore causes the closing spring 15 to be able to bring the outer piston 16 back into the closed position, irrespective of the position of the inner piston 17, and therefore to be able to completely close the main valve. This is the second automatic safety shut-off which has the effect that a refueling operation can take place only if a minimum pressure above the switching threshold is present at the inlet of the fuel pump nozzle.

The first automatic safety shut-off functions in a conventional manner by means of the membrane 23. The space above the membrane 23 communicates with a conventional sensor line which opens out at the discharge tip of the discharge pipe. If, during a refueling operation, the liquid level reaches the discharge pipe and therefore the end of said sensor line, the pressure ratios on both sides of the membrane 23 change in such a manner that the pressure above the membrane is reduced and the latter therefore draws the holder 22 upward and therefore draws the membrane rollers 20 out of the locking position thereof. The locking of the inner piston 17 and outer piston 16 is released, the closing spring 15 can press the outer piston 16 into the closed position, and can close the main valve and therefore end the refueling operation. The details of said operative mechanism which is known from the prior art are described, for example, in DE 10 2008 010 988 B3 and do not need more detailed explanation here.

Various refueling operations using a fuel pump nozzle according to the invention will be described below.

In a first variant embodiment, a fuel tank is supposed to be filled completely. The refueling operation is carried out here in a conventional manner at full pumping pressure of the filling pump until, after the liquid level has risen as far as the end of the discharge pipe 3, the first automatic safety shut-off described draws the membrane 23 upward, lifts the membrane rollers 20 out and therefore causes the outer piston 16 to snap back into the closed position and closes the main valve. The fuel pump nozzle can now be suspended again back on the filling pump and is ready for a new refueling operation. As already mentioned, the closing spring 15 presses the main valve into the closed position at high force such that complete tightness is ensured at any pressure occurring during operation at the outlet 2.

In a second variant embodiment, the user preselects a certain quantity of fuel (or a certain amount to be paid) which is not sufficient to completely fill the tank. The refueling operation is begun in the manner described above. Shortly before the preselected quantity of fuel is reached, the feeding power of the fuel pump in the filling pump is significantly reduced in order to be able to activate the preselected quantity of fuel with great precision. For example, the feeding power can be reduced to approximately 2 l/min shortly before the preselected quantity of fuel is reached. In the exemplary embodiment, at said low feeding power, a pressure of 0.27 bar is present upstream of the main valve and therefore also in the pressure port duct 21 and in the space 27 above the piston 25. Said pressure suffices to leave the piston 25 in the lower position, illustrated in FIG. 2, and therefore to retain the lock between the inner piston 17 and outer piston 16. At said low feeding power, the main valve or the first partial body 6 thereof is already drawn in the direction of the closed position under the action of the full hose spring 16 such that only a small opening gap still remains.

After the preselected quantity of fuel is reached, the fuel pump shuts off completely and the "full hose mode" starts. This means that the main valve is not yet closed again by the closing spring 15 by transmission of force from the outer piston 16 but rather is merely held in the closed position by the full hose spring 13. Discharging of the hose through the fuel pump nozzle or theft of fuel by "milking" of the hose is thereby prevented. On the other hand, it has to be ensured that, before the fuel pump nozzle is hung into the filling pump and therefore the refueling operation is completely ended, the full hose operation is cancelled again and the main valve is pressed completely into the closed position by the very much more powerful closing spring 15, even if the user forgets to move the, for example latched, switching lever 4 back into the starting position thereof. In other words, it has to be ensured that the lock between the inner piston 17 and outer piston 16 is cancelled.

For this purpose, it is provided according to the invention that the full hose spring 13 presses the main valve into the closed position in a tilted manner in the full hose mode and reduces the tightness of said main valve. As can be seen in FIG. 6, a holding region or holding arm 11 of the valve stem guide has a spacer 28 facing in the axial direction. Said spacer comes to bear at 12 (FIG. 2) against the abutment of the valve housing 1 and thereby causes the valve stem guide not to be aligned with the axis of symmetry of the valve seat 5 under the action of the full hose spring 13, which is designed as a compression spring, but rather to sit in the inlet in an oblique or tilted manner. By means of said tilting, the first partial body 6 of the main valve is also drawn against the valve seat 5 in a tilted manner under the action of the full hose spring 13 such that the tightness or the sealing pressure is reduced in partial regions of the circumference. As illustrated in particular in FIG. 5, said oblique position of the valve guide brings about a lower contact pressure in the region 29 in comparison to the region 30. The sealing pressure in the region 29 and therefore the sealing pressure of the main valve in the full hose mode as a whole is around approximately 0.1 bar.

Said reduced sealing pressure has the effect that, after the fuel pump is switched off when the preselected quantity of fuel is reached, the pressure of 0.27 bar which is initially still present at the inlet (which pressure in principle can also be raised, for example, by solar insolation on a black fuel hose) dissipates reliably to approximately 0.1 bar within a short time. In the process, the pressure reliably drops below the switching threshold of the second automatic safety shut-off of 0.17 bar. When the pressure drops below said switching threshold, i.e. the pressure in the pressure port duct 21 and space 27 above the piston 25 drops, the force of the spring 24 exceeds the compressive force exerted on the piston 25 from above from the space 27, and the second automatic safety shut-off is now triggered and the piston 25 moves upward and draws the membrane rollers 20 out of the locking position thereof. The invention therefore ensures that the full hose mode does not last indefinitely but rather that the second automatic safety shut-off reliably triggers and therefore brings the main valve back into the position in which it is acted upon fully by the closing force of the closing spring 15. If the closing spring 15 acts from downstream on the main valve, said pressurization which far exceeds the force of the full hose spring 13 takes place completely symmetrically such that a tilting or oblique position which could reduce the tightness no longer occurs.

Figure 3:
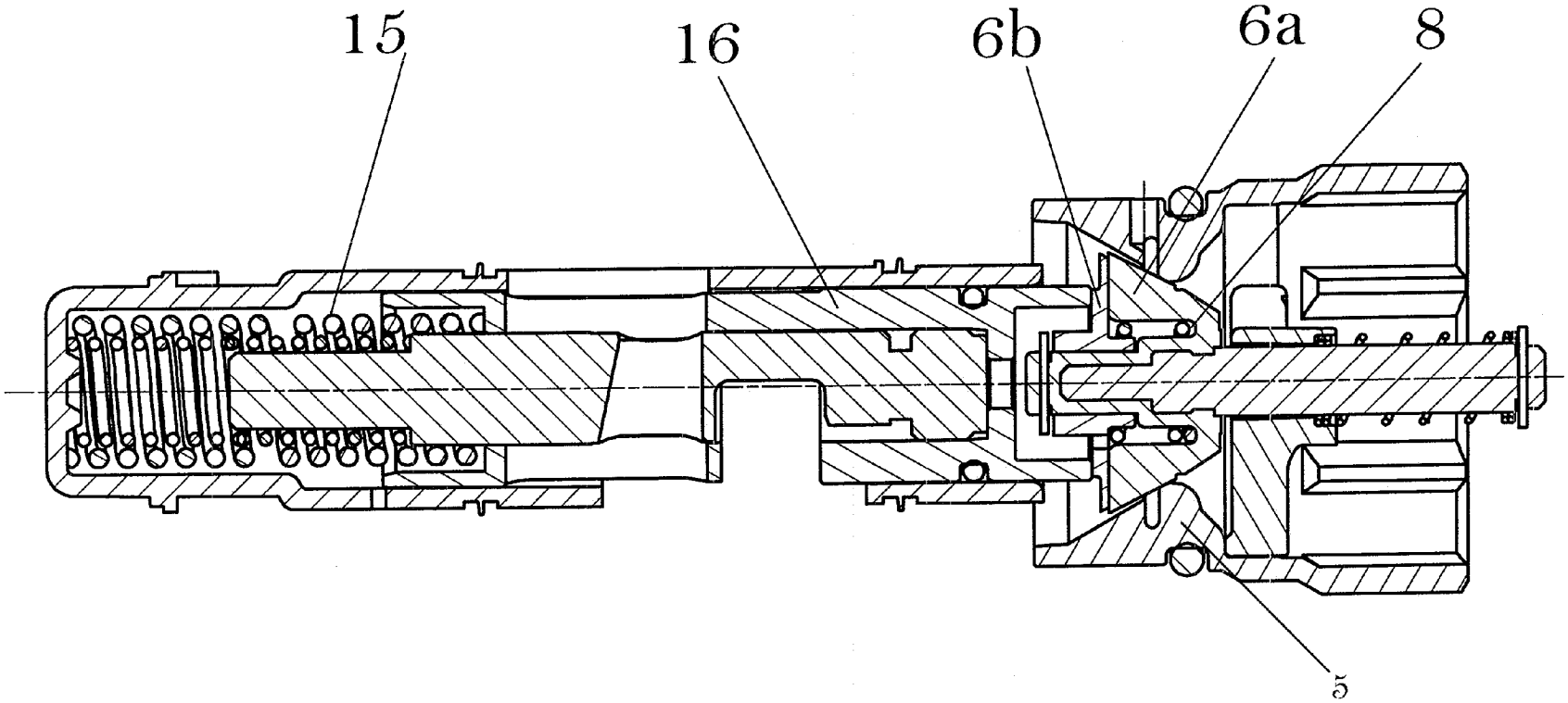
FIG. 3 shows, in a detail from FIG. 1, the fuel pump nozzle in the closed position.

FIGS. 3 to 5 show once again different operating states of the fuel pump nozzle according to the invention for better understanding. FIG. 3 shows the closed position in which the force of the closing spring 15 acts from downstream on the main valve via the outer piston 16. The two partial bodies 6*a* and 6*b* are pressed together counter to the action of the spring 8, and the pressurization of the main valve into the closed position is symmetrical.

Figure 4:
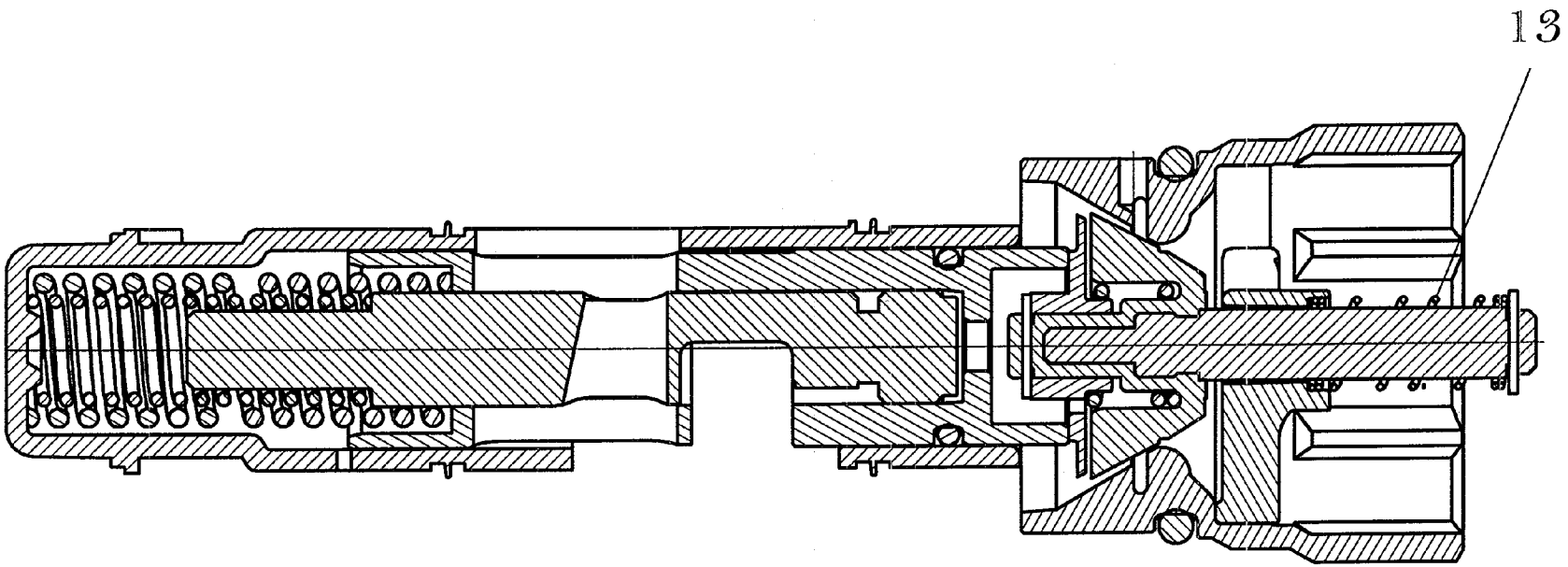
FIG. 4 shows the fuel pump nozzle at a low feed rate.

FIG. 4 shows a position in which the main valve is slightly open and is prestressed into the closed position by the full hose spring 13. A small flow takes place here at a pressure of 0.27 bar at the inlet.

Figure 5:
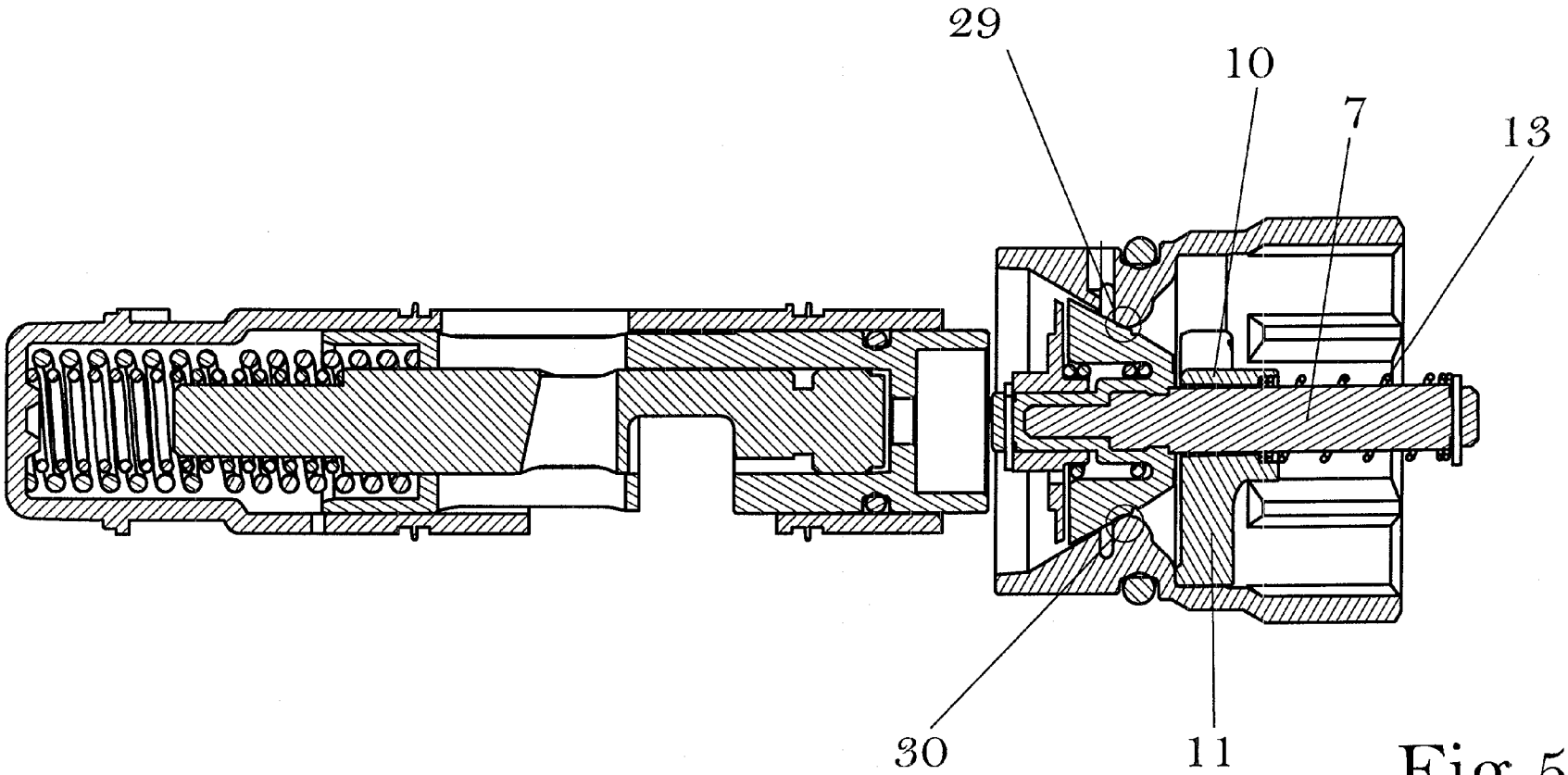
FIG. 5 shows the fuel pump nozzle in the full hose mode.
Figure 6:
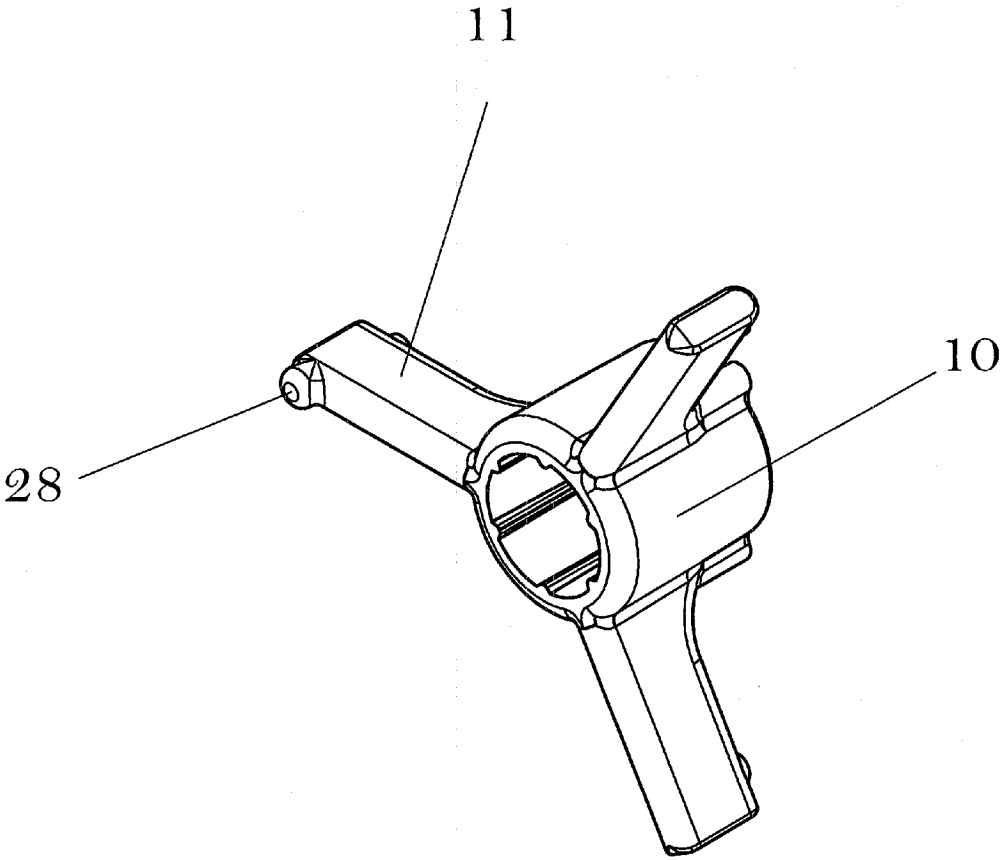
FIG. 6 shows a view of the valve stem guide according to the invention.

FIG. 5 shows the full hose mode in which the main valve is pressed into the closed position only by the full hose spring 13. Owing to the tilted guidance of the valve stem 7 by means of the valve stem guide 10, 11, the sealing pressure in the region 30 is reduced in the manner described to approximately 0.1 bar.

The invention claimed is:

1. A fuel pump nozzle, with an inlet (2), a discharge pipe (3), a main valve for controlling the stream of liquid between the inlet (2) and discharge pipe (3), a switching lever (4) for actuating the main valve, a first automatic safety shut-off which moves the main valve into a closed position if the liquid level in a tank to be filled reaches a filling level sensor arranged in the region of the discharge pipe (3), a second automatic safety shut-off which moves the main valve into the closed position if a liquid pressure at the inlet (2) drops below a minimum value, and a mechanism (13) for prestressing the main valve into the closed position, said mechanism bringing about a variable opening cross section of the main valve depending on the liquid pressure at the inlet (2), wherein the main valve comprises a valve seat having an axis and the main valve is pressed into the closed position in a tilted manner with respect to the axial direction of said valve seat under the action of the mechanism for prestressing the main valve into the closed position in a full hose mode such that a tightness of said main valve is reduced.

2. The fuel pump nozzle as claimed in claim 1, wherein the mechanism for prestressing the main valve into the closed position has a full hose spring (13).

3. The fuel pump nozzle as claimed in claim 1, wherein the main valve is designed as a conical valve (6) and the valve stem guide (10, 11) is designed such that the main valve is pressed against the valve seat (5) with an asymmetrical distribution of force under the action of the mechanism (13) for prestressing the main valve into the closed position in the full hose mode.

4. The fuel pump nozzle as claimed in claim 1, wherein the sealing pressure of the main valve in the full hose mode is 0.1 to 0.15 bar.

5. The fuel pump nozzle as claimed in claim 1, wherein the switching threshold of the second automatic safety shut-off which moves the main valve into the closed position if the liquid pressure at the inlet (2) drops below a minimum value is 0.15 to 0.25 bar.

6. The fuel pump nozzle as claimed in claim 1, wherein the switching threshold of the second automatic safety shut-off which moves the main valve into the closed position if the liquid pressure at the inlet (2) drops below a minimum value is at least 0.05 bar.

7. The fuel pump nozzle as claimed in claim 1, wherein the main valve has a valve stem guide (10, 11) which tilts under the action of the mechanism for prestressing the main valve into the closed position in the full hose mode and guides the valve stem (7) of the main valve at an angle to the axis of symmetry of the main valve seat (5).

8. The fuel pump nozzle as claimed in claim 7, wherein the valve stem guide (10, 11) is pressed against an abutment (12) in a tilted manner under the action of the mechanism for prestressing the main valve into the closed position in the full hose mode.

9. The fuel pump nozzle as claimed in claim 8, wherein, in the region of the contact surfaces with the abutment (12), the valve stem guide (10, 11) has spacers (28) facing in the axial direction in subregions of the circumference.

10. A valve stem guide for a fuel pump nozzle as claimed in claim 1, with a stem guiding sleeve (10) and with holding regions (11) which extend radially outward from the stem guiding sleeve (10) and are designed to bear axially against an abutment (12), wherein, when the holding regions (11) are pressed against an abutment (12) of rotationally symmetrical design, the stem guiding sleeve (10) takes up an angular position in which the axis of symmetry thereof differs from the axis of symmetry of the abutment (12) of rotationally symmetrical design.

11. The valve stem guide as claimed in claim 10, wherein the holding regions (11) have spacers (28) facing in the axial direction in subregions of the circumference.

12. The fuel pump nozzle as claimed in claim 1, wherein the switching threshold of the second automatic safety shut-off which moves the main valve into the closed position if the liquid pressure at the inlet (2) drops below a minimum value is at least 0.1 bar above the sealing pressure of the main valve in the full hose mode.

* * * * *